US006466193B1

(12) United States Patent
Anai

(10) Patent No.: US 6,466,193 B1
(45) Date of Patent: Oct. 15, 2002

(54) IMAGE DISPLAY DEVICE AND METHOD FOR DISPLAYING IMAGE

(75) Inventor: Kimio Anai, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/346,113

(22) Filed: Jul. 1, 1999

(30) Foreign Application Priority Data

Jul. 3, 1998 (JP) ..... 10-189119

(51) Int. Cl.[7] ..... G09G 3/36
(52) U.S. Cl. ..... 345/99; 345/204
(58) Field of Search ..... 345/204, 211, 345/212, 213, 127, 98, 99, 100, 689, 214; 348/445, 634

(56) References Cited

U.S. PATENT DOCUMENTS 5,223,928 A * 6/1993 Hamada ..... 358/140
5,467,142 A * 11/1995 Ichinokawa ..... 348/556
5,940,061 A * 8/1999 Sato ..... 345/99
6,008,789 A * 12/1999 Anai et al. ..... 345/99
6,181,317 B1 * 1/2001 Taguchi et al. ..... 345/132
6,288,751 B1 * 9/2001 Yatomi et al. ..... 348/565

* cited by examiner

*Primary Examiner*—Bipin Shalwala
*Assistant Examiner*—Mansour M. Said
(74) *Attorney, Agent, or Firm*—Oblon, Spivak, McClelland, Maier & Neustadt, P.C.

(57) ABSTRACT

There is disclosed a device and method for displaying images on a first area A and a second area B of the display screen of a liquid crystal display device. The first area A has an aspect ratio of 12:9. The second area B has an aspect ratio of 9:4. An image signal is displayed on the first area A, while a remaining area signal is displayed on the second area B. The liquid crystal display device has a control circuit that produces a horizontal clock signal having a frequency of fck3 and a horizontal start signal XST during 0.8H of one horizontal scanning period of 1H. Either image signal VD1 or VD2 corresponding to the first area A having an aspect ratio of 12:9 is sampled. The frequency fck3 satisfies the relation 2×fck3=3×fck1 (where fck1 is the number of pixels on a horizontal line×fh/0.8). The control circuit produces a horizontal clock signal (XCK) having a frequency of fck4 and the horizontal start signal XST during a period shorter than the remaining period of 0.2H. A remaining area signal corresponding to the second area B is sampled. The frequency fck4 satisfies the relation fck4>fck1.

8 Claims, 9 Drawing Sheets

IMAGE DISPLAY DEVICE AND METHOD FOR DISPLAYING IMAGE

BACKGROUND OF THE INVENTION

1. Field of the Invention

The present invention relates to an image display device and method for displaying images by sequentially sampling image signals being inputted for a display screen having an aspect ratio of X:Y.

2. Description of the Related Art

Display devices typified by liquid crystal display devices have advantages in being thin, lightweight, and having lower power consumption. By making use of, these features, they are used as display devices for personal computers and word processors and as display devices for TVs and car navigation systems. Furthermore, they are used as projection displays. In this way, they are used in various applications. Among. others, active matrix liquid crystal display devices (AMLCDS) including display screens having display pixels arranged in rows and columns, each of which pixel is electrically connected with switching elements, can realize good image quality without crosstalk between adjacent pixels. Because of these features, active matrix liquid crystal display devices are being earnestly investigated and developed. In recent years, the aspect ratio of the display screen has shifted from 4:3 to 16:9 at which the image is elongated in the direction of horizontal scanning and which permits visual perception of a large-sized screen.

Where an image signal such as a TV signal having information about 4:3 aspect ratio picture is displayed on a liquid crystal display device having a display screen with an aspect ratio of 16:9, it is common practice to sample a previously image-processed picture signal at successive points by an image-processing technique using a frame memory or the like, and then the image is displayed.

FIG. 4 is a block diagram schematically showing the configuration of the prior art image display device. For example, this device has an input processing circuit 1 that is composed of a demodulator circuit 103, a matrix circuit 104, and an analog-to-digital converter circuit 105 as shown in FIG. 5. An image signal is applied via input terminals 101 and 102 and demodulated into brightness signals Y1, Y2, chrominance signals C1, C2, and synchronizing signals S1, S2 by the demodulator circuit 103. Then, the matrix circuit 104 demodulates three primary signals R1, G1, B1; R2, G2, and B2 from the brightness signals Y1, Y2 and the chrominance signals C1, C2. The three primary color signals R1, G1, B1; R2, G2, B2 and synchronizing signals S1, S2 are applied to the A/D converter circuit 105, which converts the input signals into digital form, or image signals VD1 and VD2. These image signals VD1 and VD2 are supplied to a frame synchronizer circuit 2 shown in FIG. 1.

As shown in FIG. 6, the frame synchronizer circuit 2 consists of a control circuit 201 and a frame memory 202. The control circuit 201 controls reading and writing of the image signal VD2 to and from the frame memory 202 in response to the synchronizing signals S1 and S2 supplied to the control circuit 201. The image signals VD1 and VD2, which are synchronized to each other on frame period, are supplied to a data converter circuit 3 shown in FIG. 4.

The data converter circuit 3 converts data about the image signals VD1, VD2 into data adapted for image display on the liquid crystal display device 7 and sends the data to an image synthesizer circuit 5. A remaining area signal generator circuit 4 produces a remaining area signal that is supplied to the liquid crystal display device 7 except for the effective image display period for the liquid crystal display device 7. The image synthesizer circuit 5 produces a combination of the remaining area signal and an image signal produced from the data converter circuit 3. The synthesized image signal from the image synthesizer circuit 5 is sent to an output processing circuit 6. This output processing circuit 6 performs various kinds of processing, such as digital-to-analog conversion, gamma correction, and polarity switching, to convert the signal to a signal adapted for the liquid crystal display device 7.

As shown in FIG. 7, the liquid crystal display device 7 comprises a liquid crystal panel 701, four X-driver circuits 703-1, 703-2, 703-3, 703-4 electrically connected with the liquid crystal panel 701, a Y-driver circuit 704 for supplying scanning pulses for display panel, and a control circuit portion 705. The four X-driver circuits 703-1, 703-2, 703-3, and 703-4 sample an image signal to thereby supply a desired voltage for display panel.

Although not illustrated in the figure, the liquid crystal panel 701 has a layer of a twisted-nematic liquid crystal sandwiched between an array substrate and a counter substrate via orientation films. A sealing material makes these components stationary relative to each other. Polarizing plates are mounted on the outer surfaces of the substrates such that their axes of polarization are mutually perpendicular to each other. As an example, 320×3 signal lines Xi (i=1, 2, . . . , 960) and 240 scanning lines Yj (j=1, 2, . . . , 240) are arranged to extend perpendicularly to each other. Pixel electrodes consisting of indium-tin oxide (ITO) are arranged near the intersections of the signal lines Xi and scanning lines Yj via inverted-staggered thin-film transistors (TFTs). These TFTs comprise a thin film of amorphous silicon as an active layer. Auxiliary capacitor lines Cj (j=1, 2, . . . , 240) extending parallel to the scanning lines Yj are arranged on the array substrate. These auxiliary capacitor lines have regions overlapping with the pixel electrodes. The pixel electrodes and the auxiliary capacitor lines Cj form auxiliary capacitors (CS) at the pixels.

The counter substrate has layers of color filters (not shown) of three primary colors red (R), green (G), and blue (B) that are positioned between matrix light-shielding layers (not shown) to achieve color display. One of the light-shielding layers acts to shield gaps among the TFTs formed on the array substrate, the signal lines Xi, and the pixel electrodes. The other light-shielding layer serves to shield the gaps between the scanning lines Yj and the pixel electrodes. Furthermore, a counter electrode consisting of ITO as described above is located on the counter substrate.

The control circuit portion 705 of the liquid crystal panel 701 supplies a horizontal clock signal (XCK), a horizontal start signal (XST), and image signals to the X-driver circuits 703-1, 703-2, 703-3, and 703-4 and produces a vertical clock signal YCK and a vertical start signal YST to the Y-driver circuit 704.

One example of the data converter circuit 8 is shown in FIG. 8. One form of display provided by the liquid crystal display device 7 is shown in FIGS. 9A–9D. The structure of the data converter circuit 8 is described in detail by referring to FIGS. 8 and 9A–9D. The data converter circuit 8 comprises 1H memory circuits 301, 302, 310, writing control circuits 303, 311, reading control circuits 304, 312, selector circuits 305, 306, 307, 308, and a digital filter 309.

It is assumed that the liquid crystal display device 701 uses a display screen 702 with an aspect ratio of 16:9 as shown in FIG. 9A. The selector circuit 307 of the data conversion circuit 3 supplies that of the image signals VD1 and VD2 selected by the selector circuit 306 to the image synthesizer circuit 5. The image signal supplied in this way is displayed on the viewing screen with an aspect ratio of 16:9 during an effective display period that is 80% of the horizontal scanning period of 1 H. In consequence, a display in the form shown in FIG. 9A is provided.

Then, the display screen 702 is divided into display areas A and B with an aspect ratio of 9:8 as shown in FIG. 9B. Image signals are displayed on these display areas. In response to the input synchronizing signal S1 and clock signal, the writing control circuit 303 thins out the data about the two image signals VD1 and VD2 into half and writes the thinned out data into the 1 H memory circuits 301 and 302, the image signals VD1 and VD2 being synchronized to the frame and supplied from the frame synchronizing circuit 2.

In response to the input synchronizing signal S1 and clock signal, the reading control circuit 304 reads the whole data from the 1 H memory circuits 301 and 302 in a ½ H period. The selector circuit 307 causes the image signals read from the 1 H memory circuits 301 and 302 to be selectively passed through the selector circuit 305 and thus the time-shared, multiplexed image signals are supplied to the image synthesizer circuit 5. The supplied signals are displayed on the viewing screen with an aspect ratio of 16:9 during an effective display period that is 80% of the 1 H horizontal scanning period. Consequently, the image signals VD1 and VD2 or the image signals VD2 and VD1 can be displayed on the display areas A and B, respectively, shown in FIG. 9B.

It is assumed that the display screen 702 is divided into a first display area A and a second display area B with aspect ratios of 12:9 (4:3) and 9:4, respectively, as shown in FIG. 9C or 9D. An image signal is displayed on the area A, while a remaining area signal is displayed on the area B.

The selector circuit 308 of the data converter circuit 3 supplies either one of the input image signals VD1 and VD2 to the digital filter 309. This digital filter 309 interpolates the image signal supplied via the selector circuit 308, based on an interpolation operating control signal supplied from the writing control circuit 311, on an interpolation clock signal, and on the clock signal described above, so that three data items of the image signal are derived from every four data items inputted from the selector circuit 308 and then supplied to the 1 H memory circuit 310. The writing control circuit 311 writes the output signal from the digital filter 309 into the 1 H memory circuit 310 in response to the interpolation clock signal. In response to the input synchronizing signal S1 and clock signal, the reading control circuit 312 is clocked to read out all the data written with the interpolation clock signal.

The selector circuit 307 receives the image signal from the 1 H memory circuit 310 and sends it to the image synthesizer circuit 5. This image synthesizer circuit 5 receives an image signal from the data conversion circuit 3 that has been compressed on the time axis (on time base) to ¾ of the effective display period, which effective display period is 80% of the 1 H horizontal scanning period of the image signal. Also, the data conversion circuit 3 receives the remaining area signal from the remaining area signal generator circuit 4 that is supplied during the remaining period that is ¼ of the effective display period. The image synthesizer circuit 5 produces the combination of these two input signals and output to the output processing circuit 6. Since the image in the effective display period is displayed on the viewing screen with the aspect ratio of 16:9, the image signal and the remaining area signal can be displayed on the areas A and B, respectively, shown in FIGS. 9C and 9D.

In the prior art technique described above, the data converter circuit 3 is made complex in configuration to divide the display screen, horizontally into equal or unequal picture areas with various aspect ratios, such as 12:9, 9:4, 9:8 when an aspect ratio of the display screen is 16:9. The selector circuit 306 is necessary to display the image signal on the display screen with an aspect ratio of 16:9. The 1 H memory circuits 301 and 302 are needed to display the image signal on a pair of image areas with an aspect ratio of 9:8. Furthermore, the writing control circuit 303, the reading control circuit 304, and the selector circuits 305, 307 are necessitated. In addition, in order to display the image display on areas having arbitrary aspect ratios such as 12:9 and 9:4, it is necessary to provide the selector circuit 308, the digital filter 309, the 1 H memory circuit 310, the writing control circuit 311, and the reading control circuit 312.

That is, at least the three circuit systems corresponding to three aspect ratios of the displayed images need to be added. This complicates the structure of the data converter circuit 3. Especially, the circuit of the writing control circuit 311 that produces the interpolation operating control signal and the interpolation clock signal are rendered complex. Furthermore, in order that the function of the digital filter 309 acting to thin out data in writing data about the image signal into the 1 H memory circuit 310 correspond to any desired aspect ratio, plural kinds of circuits must be used in combination to realize plural kinds of filter functions. This increases the size of the digital filter 309, thus leading to an increase in the cost of the image display device.

SUMMARY OF THE INVENTION

It is an object of the present invention to provide an improved image display device that has a simplified structure but is capable of appropriately displaying image signals on image display areas with arbitrary aspect ratios.

A certain image display device sequentially samples inputted image signals and thereby displays images on display screen having an aspect ratio of X:Y. In accordance with the present invention, the image display device comprises an image signal synthesizer means for synthesizing for producing a synthesized image signal derived from at least one of the inputted image signals during each horizontal scanning period; a clock frequency control means for producing frequency-controlled clock signals each in accordance with respective one of horizontal display area size ratios Z/Y and (Y−Z)/Y, when to divide said display screen into a first area having an aspect ratio of X:Z (Z<Y) and a second area having an aspect ratio of X:(Y−Z); and a display control means for sampling each image signal in the synthesized image signal by respective one of said frequency-controlled clock signals and thereby displaying images on said first and second areas.

In one embodiment of the invention, the image display device is further equipped with a signal compression means for compressing the inputted image signal on the time axis and sending the compressed signal to the image signal synthesizer means described above.

In another embodiment of the invention, the aforementioned signal compression means comprises a storage means for storing the image signal, a writing control means for writing the image signal into the storage means, and a reading control means for reading out the image signal at a rate faster than the writing rate.

In a further embodiment of the invention, the aspect ratio of the first area is 9:8 while the aspect ratio of the display screen is 16:9.

In a yet other embodiment of the invention, the aspect ratio of the first area is 12:9 while the aspect ratio of the display screen is 16:9.

In the configuration in accordance with the present invention described thus far, the image signal synthesizer means produces a synthesized image signal derived from at least one of the inputted image signals during each horizontal scanning period. The clock frequency control means controls frequencies of clock signals to produce frequency-controlled clock signals each in accordance with respective one of horizontal display area size ratios Z/Y and (Y−Z)/Y, when to divide said display screen into a first area having an aspect ratio of X:Z (Z<Y) and a second area having an aspect ratio of X:(Y−Z). The display control means samples each image signal in the synthesized image signal by respective one of said frequency-controlled clock signals. Because the image signal to be displayed on the first area is sampled with the sampling clock signal that is controlled according to the horizontal display area size ratio Z/Y, the image signal is appropriately displayed on the first area. On the other hand, because the image signal to be displayed on the second area is sampled with a sampling clock signal that is controlled according to the horizontal display portion size ratio (Y−Z)/Y, the image signal is appropriately displayed on the second area.

In this way, image signals can be appropriately displayed on display areas having an arbitrary horizontal size ratio by causing the clock frequency control means to control frequencies of clock signals each in accordance with respective one of horizontal display area size ratios Z/Y and (Y−Z)/Y. This makes it unnecessary to prepare plural kinds of circuits corresponding to different aspect ratios of display areas. Hence, the circuit configuration can be simplified. Furthermore, image signals can be appropriately displayed on display areas with any arbitrary aspect ratio.

Where the display device in accordance with the present invention is equipped with the signal compression means for compressing the inputted image signal on the time axis and sending it to the image signal synthesizer means, if the image signal is compressed to 1/m of one horizontal scanning period, the sampling clock signals are controlled according to the horizontal display portion size ratio Z/Y or (Y−Z)/Y and also according to the compression ratio 1/m described above. Consequently, where a synthesized image signal from the image synthesizer means is displayed, the synthesized image signal can be sampled over one horizontal period. Hence, an appropriate display can be accomplished. Thus, the same advantages as described above can be obtained.

Where the above-described signal compression means of the device in accordance with the invention comprises the storage means for storing the image signal, the writing control means for writing the image signal into the storage means, and the reading control means for reading out the image signal at a rate faster than the writing rate, the aforementioned compression of the image signal along the time axis is achieved. Therefore, the aforementioned advantages can be realized.

Where the display screen has an aspect ratio of 16:9 and the first area has an aspect ratio of 9:8 or 12:9, the sampling clock signals are controlled with X=9, Y=16, and Z=8 or Z=12. In this case, it is obvious that the aforementioned advantages can be had.

Other objects and features of the invention will appear in the course of the description thereof, which follows.

DETAILED DESCRIPTION OF THE INVENTION

Figure 1:
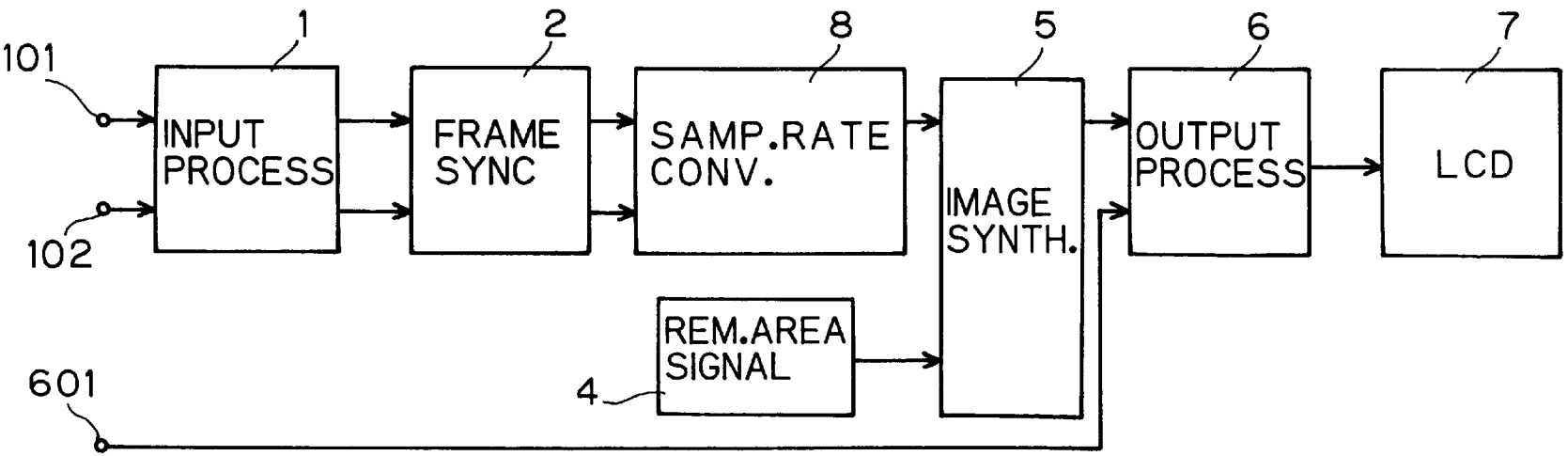
FIG. 1 is a block diagram of an image display device in accordance with the present invention.
Figure 2:
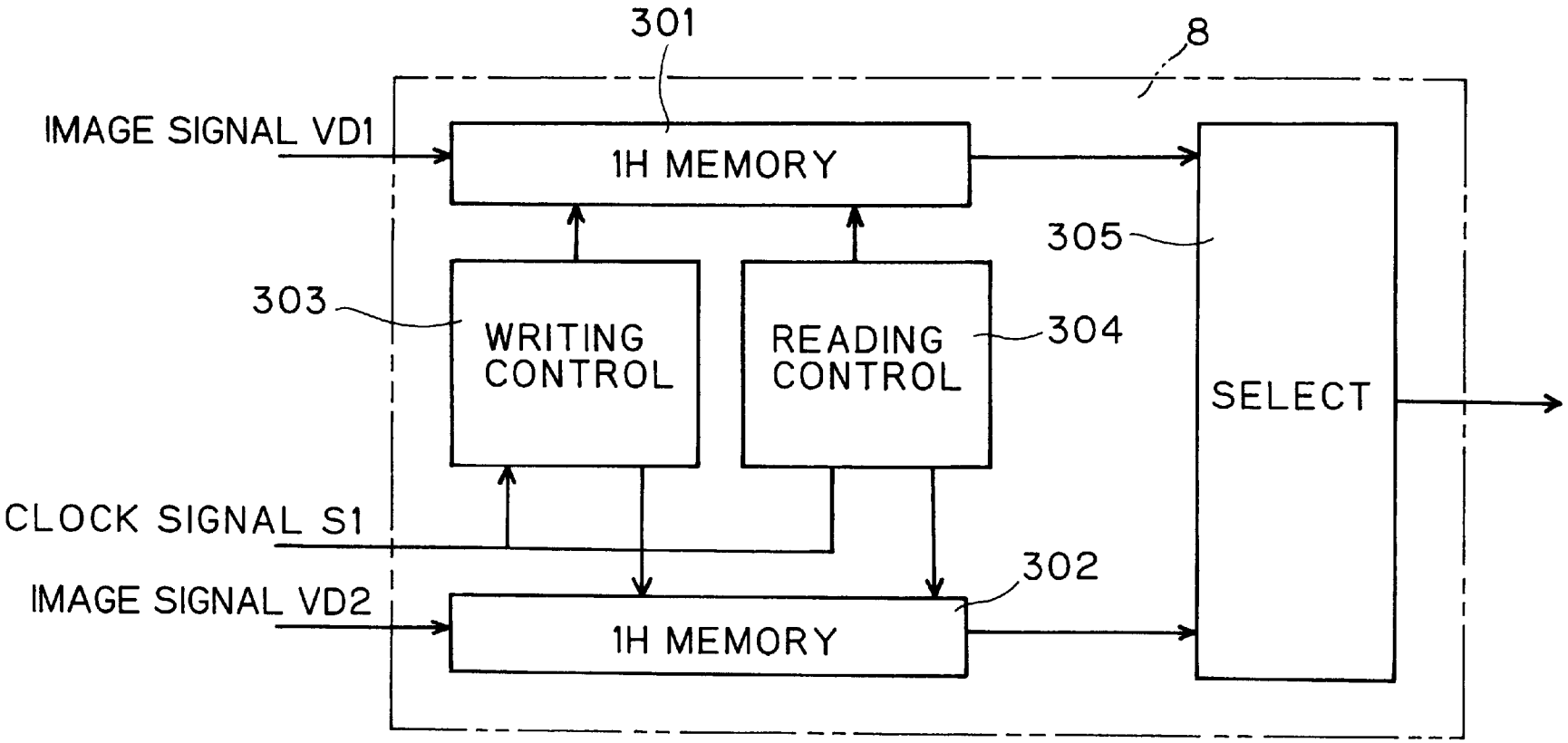
FIG. 2 is a block diagram of a sampling rate converter circuit 8 included in the image display device shown in FIG. 1.

An image display device in accordance with the present invention is hereinafter described with reference to the accompanying drawings. FIG. 1 is a block diagram of the image display device in accordance with the invention. FIG. 2 is a block diagram schematically showing the structure of a sampling rate converter circuit 8 included in the image display device. FIG. 3 is a diagram illustrating the operation of the sampling rate converter circuit 8. Note that like components are indicated by like reference numerals in various figures and that those components which have been already described in connection with FIG. 4 will not be described.

Figure 3A:
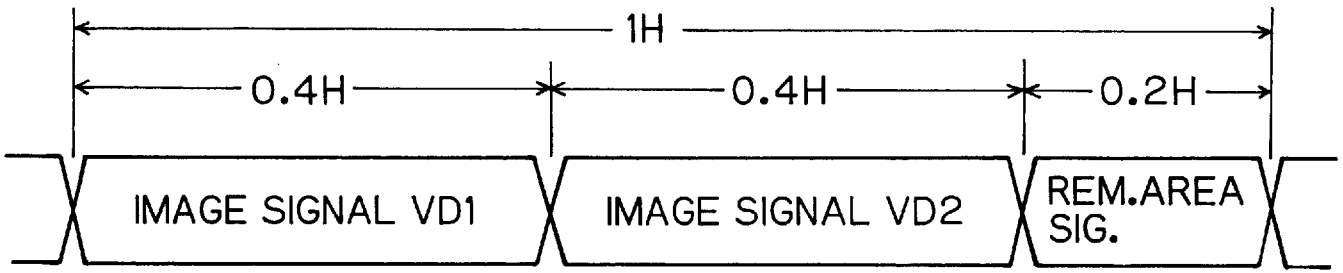
FIGS. 3A and 3B are diagrams illustrating the operation of the display device shown in FIG. 1.
Figure 3B:
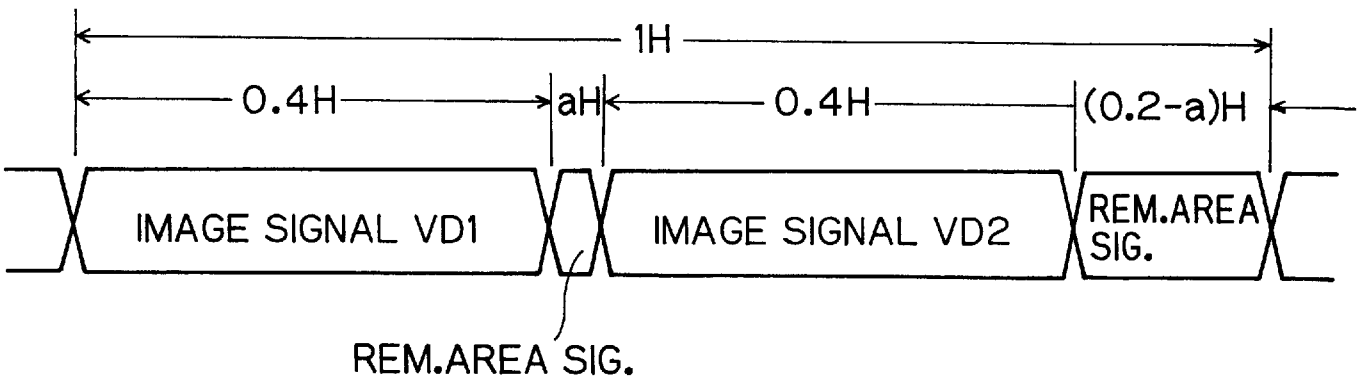
Figure 4:
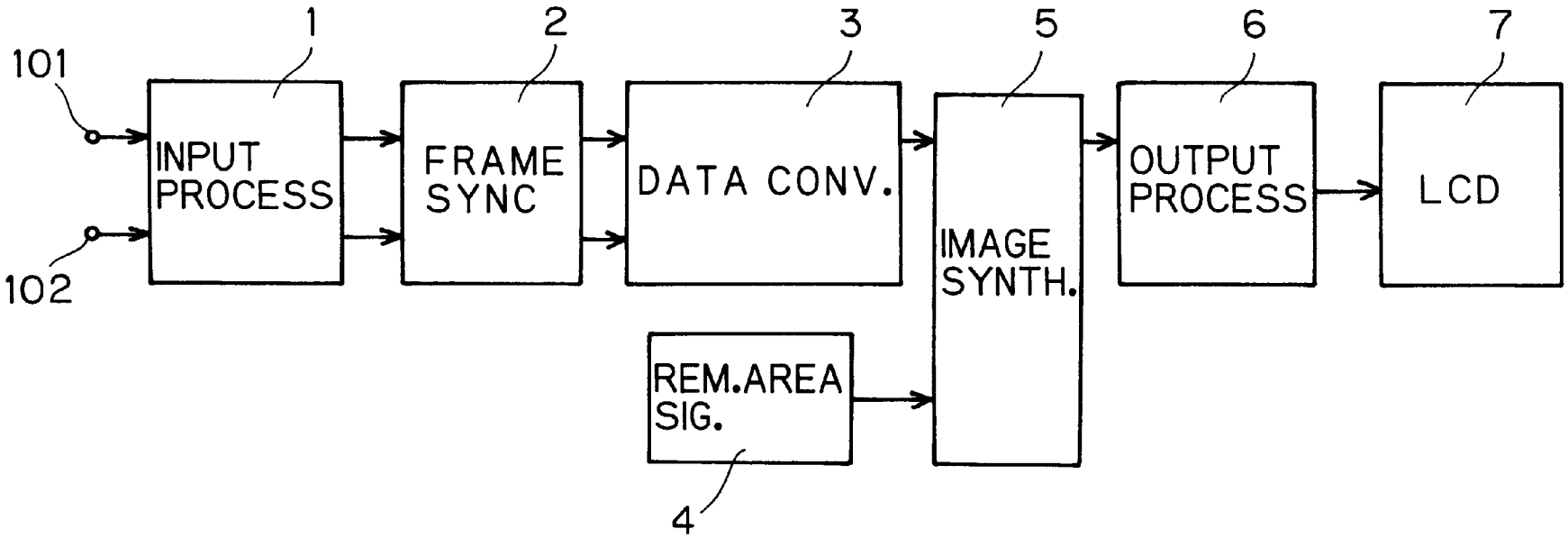
FIG. 4 is a block diagram of the prior art image display device.
Figure 5:
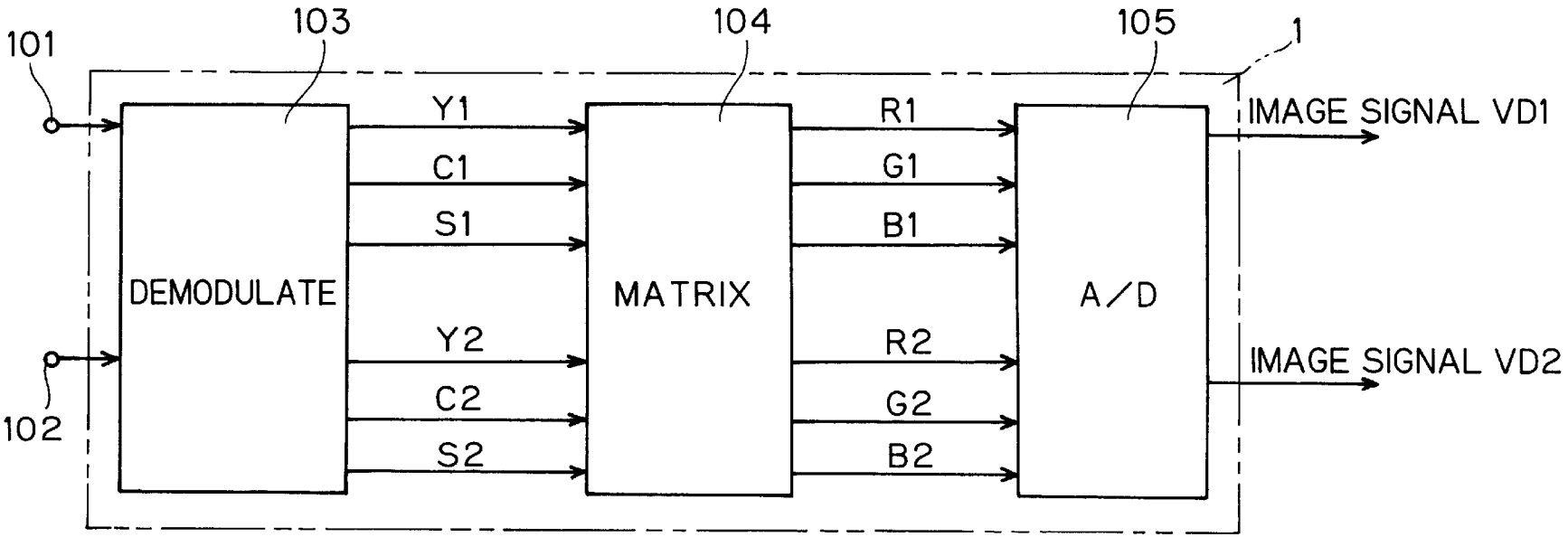
FIG. 5 is a block diagram of an input processing circuit 1 included in the prior art image display device shown in FIG. 4.
Figure 6:
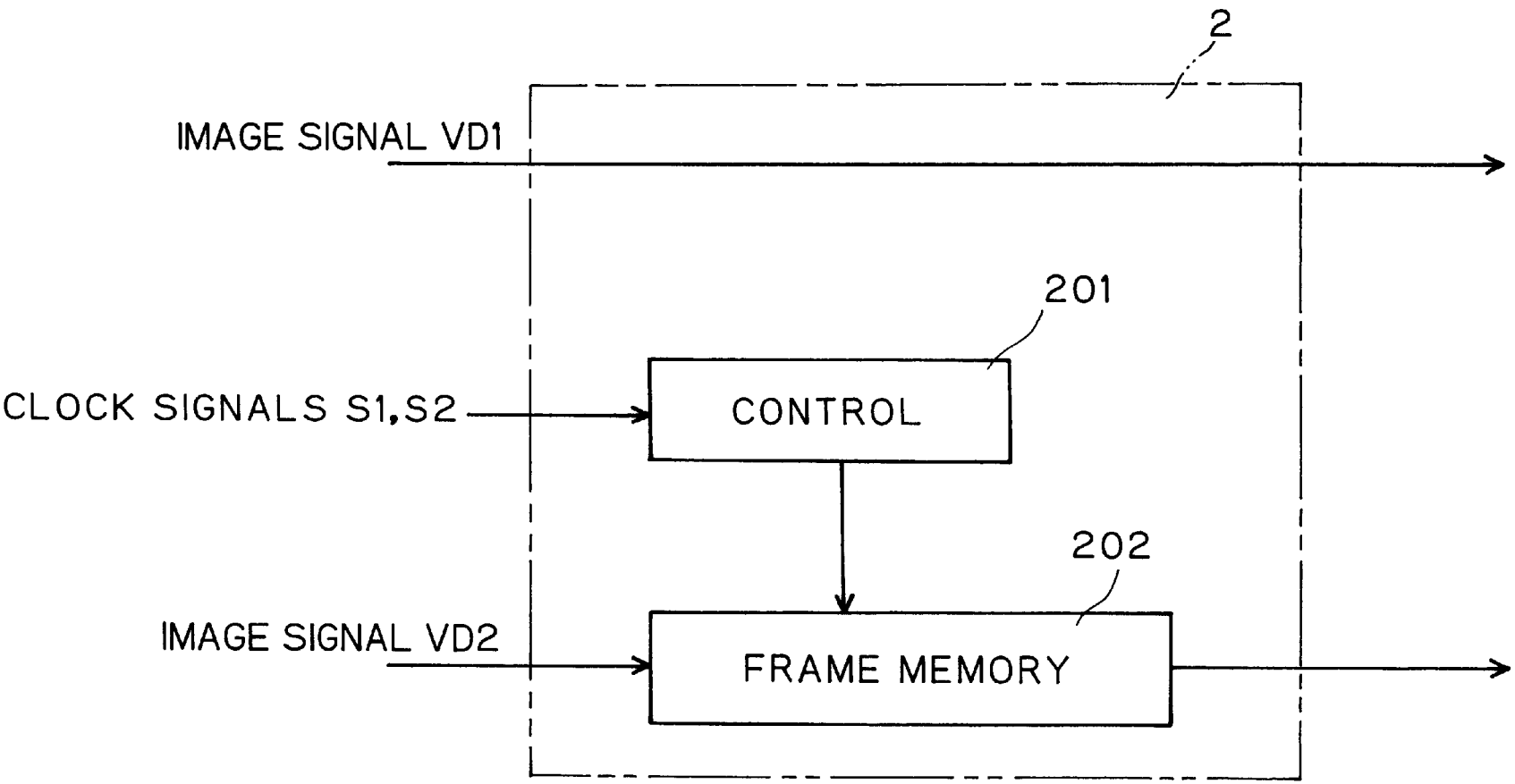
FIG. 6 is a block diagram of a frame synchronizing circuit 2 included in the prior art image display device shown in FIG. 4.
Figure 7:
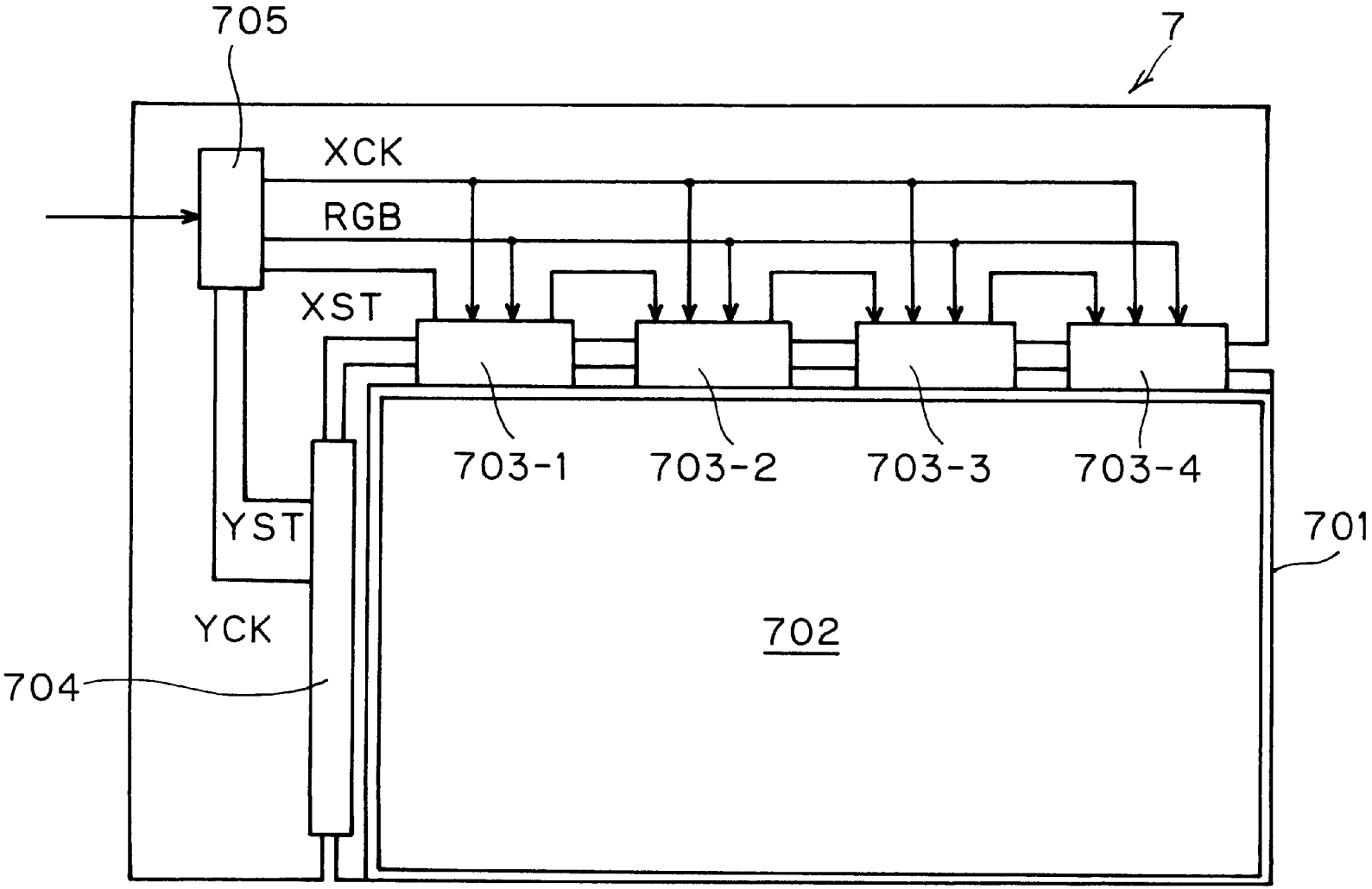
FIG. 7 is a block diagram of a liquid crystal display device 7 included in the prior art image display device shown in FIG. 4.
Figure 8:
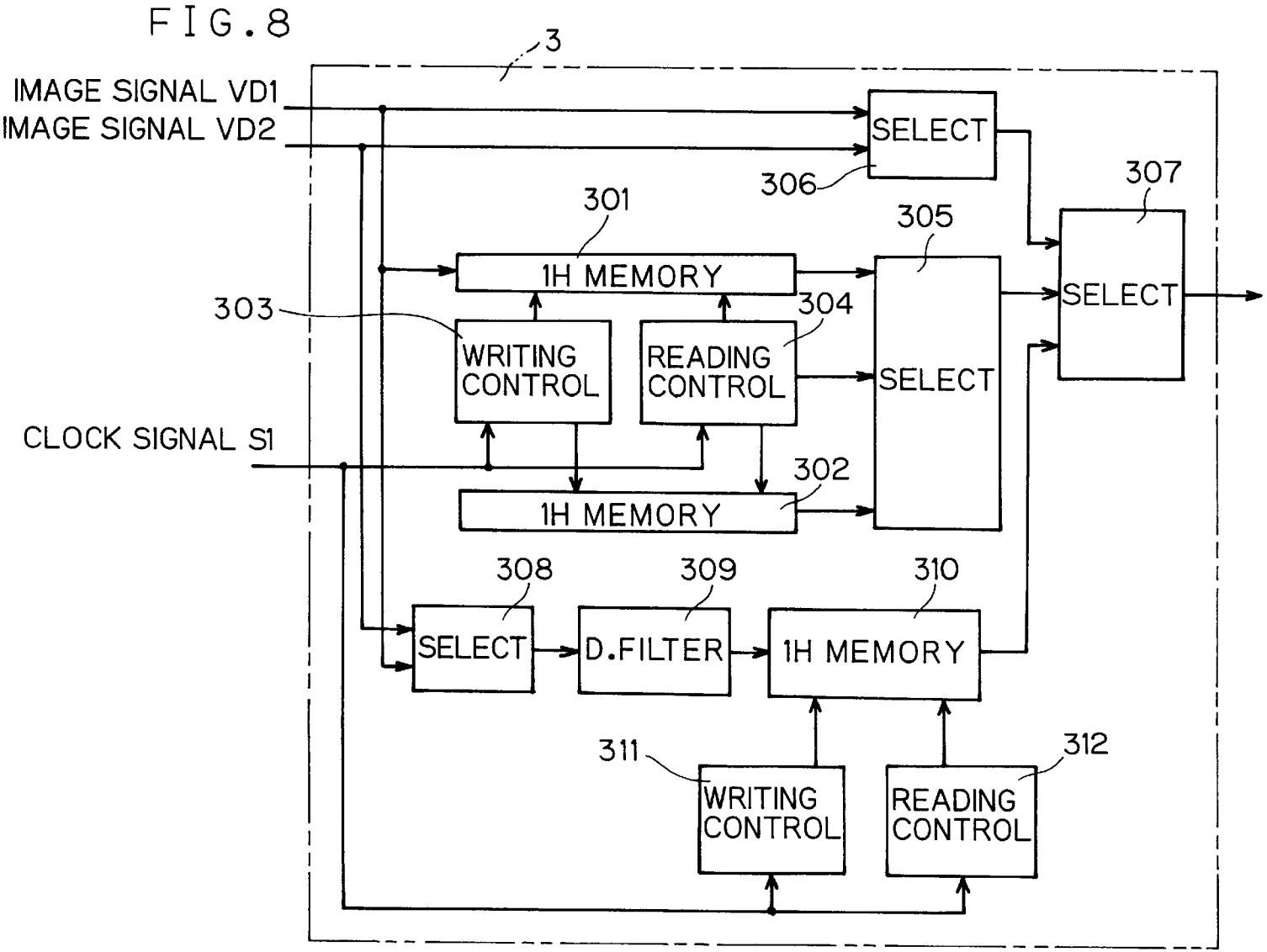
FIG. 8 is a block diagram of a data converter circuit 3 included in the prior art image display device shown in FIG. 4.

As shown in FIG. 2, the sampling rate converter circuit 8 comprises 1 H memory circuits 301, 302, a writing control circuit 303, a reading control circuit 304, and a selector circuit 305. The writing control circuit 303 is controlled according to a synchronizing signal S1 and a clock signal, receives two frame-synchronized image signals VD1 and VD2 from the frame synchronizing circuit 2, and writes the signals VD1 and VD2 into the 1 H memory circuits 301 and 302, respectively, during a period of 1 H. In response to the supplied synchronizing signal S1 and clock signal, the reading control circuit 304 reads out the 1 H image data during a period of ½ H at a rate twice as high as the writing rate. The selector circuit 305 time-multiplexes the image signals VD1 and VD2 which have been compressed into the ½ H period such that they are alternately delivered within the 1 H scanning period as shown in FIG. 3A or 3B. The time-multiplexed image signals are sent to the image synthesizer circuit 5.

It is assumed that the effective display period within one horizontal scanning period of the image signals is 0.8 H and that the number of effective scanning lines is 480. The remaining area signal generator circuit 4 produces an image signal to be displayed during the remaining period of 0.2 H and during the period other than the effective 480 scanning lines. The image synthesizer circuit 5 combines the remaining area signal and the output image signal from the sampling rate converter circuit 8 as shown in FIG. 3A or 3B. The synthesized image signal is supplied to the output processing circuit 6.

In following, mode of image displaying and operation of the liquid crystal display device 7 in accordance with the present invention are described by referring to FIGS. 9A–9D.

Figure 9A:
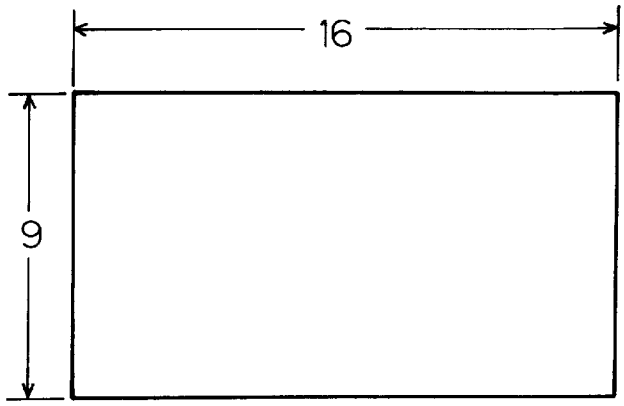
FIGS. 9A–9D are diagrams illustrating displays provided on the liquid crystal display device 7 shown in FIG. 7.

Firstly, a description will be given to a case in which, on the display screen 702, an image is displayed with an aspect ratio of 16:9 as shown in FIG. 9A. Image signals applied to the X-driver circuits 703-1, 703-2, 703-3, and 703-4 are sampled with a horizontal clock signal XCK having a fundamental frequency of fck. Let the horizontal frequency (fh=15.734 kHz) be 15.734 kHz. It follows that an image signal persisting over one horizontal scanning period and across all the pixels in one horizontal line is sampled during a period of 0.8 H. Therefore, the horizontal frequency is given by $$fck1=\text{number of pixels on horizontal line}\times fh/0.8 \quad (1)$$

Where the synthesized image signal created by the image synthesizer circuit 5 is displayed on the liquid crystal display device 7, the image synthesizer circuit 5 produces the image signal compressed on the time axis (on time base) as mentioned above. That is, the image signal corresponding to 1 H period is read out in ½ H period. Therefore, the control circuit portion 705 is required to shift data in the X-driver circuits 703-1, 703-2, 703-3, and 703-4 at a rate twice as high as the rate used where the compression is not made along the time axis. Therefore, the control circuit portion 705 produces the horizontal clock signal XCK having a frequency fck2 and a horizontal start signal XST for starting sampling of one of the image signals VD1 and VD2. The frequency fck2 is given by $$fck2=2\times fck1 \quad (2)$$

Thus, the time axis-compressed image signal data applied to the liquid crystal display device 7 from the image synthesizer circuit 5 via the output processing circuit 6 can be displayed during a scanning period of 0.8 H across 80% of the pixels included in one horizontal scanning line. Consequently, either the image signal VD1 or VD2 can be appropriately displayed on the display screen with an aspect ratio of 16:9.

Where an image signal applied via an input terminal 601 shown in FIG. 1 is displayed on the liquid crystal display device 7, the image signal applied to the output processing circuit 6 undergoes gamma correction, polarity switching, and other processing, in addition to the aforementioned digital analog conversion of the synthesized image signal. The signal is converted into a signal adapted for the liquid crystal display device 7 and supplied to it. In this case, the control circuit portion 705 delivers the horizontal clock signal XCK having a frequency of fck1 and the horizontal start signal XST. In this way, the control circuit portion 705 can display the image signal that has not been compressed along the time axis as described above during a period of 0.8 H across 80% of all the pixels on one horizontal line. Hence, a display as shown in FIG. 9A can be provided.

Figure 9B:
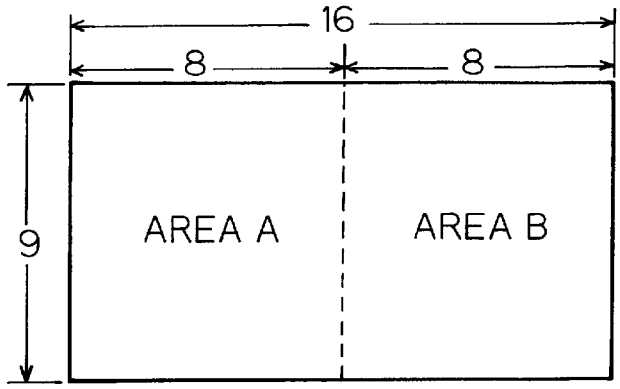

It is now assumed that the display screen 702 is divided into two areas A and B with an aspect ratio of 9:8 as shown in FIG. 9B and that image signals are displayed on the regions A and B. In this case, the sampling rate converter circuit 3 and the image synthesizer circuit 5 cooperate to time-multiplex the image signals VD1 and VD2 as shown in FIG. 3, thus forming a scanning period of 0.8 H. Therefore, the horizontal clock signal XCK having a frequency of fck1 and the horizontal start signal XST are produced in such a way that sampling is done with an effective display period equal to 0.8 H for both image signals VD1 and VD2. In this way, the control circuit portion 705 can display the two image signals VD1 and VD2, which have been compressed on the time axis and together form a scanning period of 0.8 H as described above, in a scanning period of 0.8 H across 80% of all the pixels on one horizontal line. Hence, a form of display as shown in FIG. 9B can be provided.

Figure 9C:
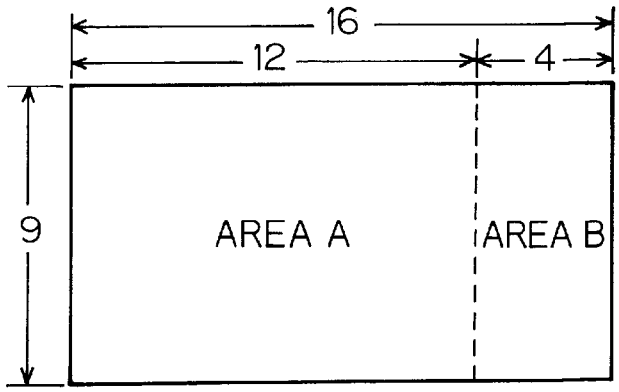
Figure 9D:
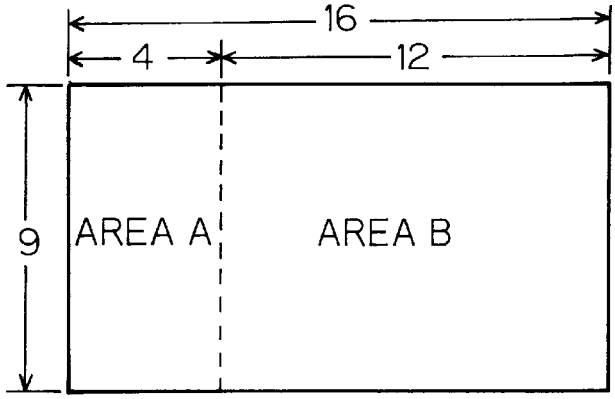

It is now assumed that the display screen 702 is divided into a first area A with an aspect ratio of 12:9 (4:3) and a second area B with an aspect ratio of 9:4 as shown in FIGS. 9C and 9D. The image signal is displayed on the region A, while the remaining area signal is displayed on the region B.

The control circuit portion 705 first produces the horizontal clock signal XCK having a frequency of fck3 and the horizontal start signal XST such that the image signal VD1 or VD2 corresponding to the first display area A with an aspect ratio of 12:9 (4:3) is sampled during 0.8 H of one horizontal scanning period of 1 H. The frequency fck3 is given by $$2\times fck3=3\times fck1 \quad (3)$$

The control circuit portion 705 produces the horizontal clock signal XCK having a frequency of fck4 and the horizontal start signal XST such that the image signal VD1 or VD2 corresponding to the second display area B is sampled during a period shorter than the remaining period 0.2 H. The frequency fck4 satisfies the relation given by $$fck4>fck1 \quad (4)$$

The Eq. (3) above is now described. The image signals compressed along the time axis are realized by reading the image signals of 1 H period in a period of ½ H by means of the reading control circuit 304, the image signals having been written in the 1 H memory circuits 301 and 302 as described above. This compressed image signal is displayed on the display screen 702 with an aspect ratio of 16:9 in a scanning period of 0.8 H across 80% of all the pixels on one horizontal line. At this time, the frequency fck2 of the horizontal clock signal XCK is determined as given by Eq. (2) above. Accordingly, where the display screen 702 is divided into the first area A with an aspect ratio of 12:9 and the second area B with an aspect ratio of 9:4 and the image signal is displayed on the display area A, the frequency fck3 of the horizontal clock signal XCK is the product of the frequency 2×fck1 of Eq. (2) and the ratio 12/16, i.e., $$fck3=2\times fck1\times 12/16=3fck½ \quad (5)$$

Thus, Eq. (3) is derived. In this manner, forms of display as shown in FIGS. 9C and 9D are obtained.

In the embodiment described above, the input image signals VD1 and VD2 of 1 H are compressed to ½ H along the time axis by the sampling rate converter circuit 8. It is to be understood that the invention is not limited to this method. Where the input image signals VD1 and VD2 of 1 H are compressed to 1/mH along the time axis by the sampling rate converter circuit 8, if either image is displayed on a display area with an aspect ratio of 9:n of the display screen 702, the horizontal clock signal XCK has a frequency fck(n), which is described below. When the synthesized image signal created by the image synthesizer circuit 5 is displayed on the liquid crystal display device 7, the image synthesizer circuit 5 produces the time axis-compressed image signal of 1 H period as described above, the image signal having been read with a period of 1/mH. The control circuit portion 705 is required to shift data through the X-driver circuits 703-1, 703-2, 703-3, and 703-4 at a rate that is m times the rate used where no compression is done along the time axis. Thus, the control circuit portion 705 produces the horizontal clock signal XCK having a frequency fck(2) and the horizontal start signal XST for starting sampling of one of the image signals VD1 and VD2. The frequency fck(2) is given by $$fck(\mathbf{2})=m\times fck\mathbf{1} \quad (6)$$

The control circuit portion 705 produces a clock signal having a frequency fck(n) that is the product of the frequency m×fck1 given in Eq. (6) and ratio n/16. Thus, an image signal can be displayed on the display screen with an aspect ratio of n/16. That is, $$fck(n)=m\times fck\mathbf{1}\times n/16=(mn/16)\times fck\mathbf{1} \quad (7)$$

In this way, the image signal that has been compressed on the time axis at an arbitrary compression ratio can be appropriately displayed on display areas with an arbitrary aspect ratio of 9:n, the display areas being obtained by dividing the display screen horizontally.

In the image display device in accordance with the present embodiment of the invention described thus far, if the display screen 702 of the liquid crystal display device 7 is divided into the first area A with an aspect ratio of X:Z (Z<Y) and the second aspect ratio of X:(Y−Z), and if image signals are displayed on the first area A and on the second area B, the frequencies of sampling clock signals XCK at which the image signals are sampled, respectively, are controlled according to the horizontal display area size ratio Z/Y or (Y−Z)/Y in the display screen 702.

Thus, where the display screen 702 is undivided or divided into plural parts and at least one image signal is displayed in plural different forms in accordance with the present embodiment, it is enough to appropriately set the sampling clock frequencies as described above. Therefore, it is not necessary to prepare different control circuits corresponding to different aspect ratios at which the display screens is divided into plural parts, unlike the prior art technique described already. The image display device can be made simpler in construction. Furthermore, image signals can be appropriately displayed on display areas with arbitrary aspect ratios.

In accordance with the present invention, if images are displayed in plural different forms on areas obtained by dividing the display screen with a certain aspect ratio, an appropriate display can be accomplished for each form of display. Furthermore, the invention permits the image display device capable of accomplishing such appropriate displays to have simplified structure and be fabricated economically.

What is claimed is:

1. An image display device for displaying images on a display screen having an aspect ratio of X:Y by sequentially sampling inputted image signals, said image display device comprising:

a signal compression means for compressing the inputted image signals along a time axis at a predetermined compression ratio;

an image signal synthesizer means for producing a synthesized image signal from at least one of compressed image signals outputted from the signal compression means during each horizontal scanning period;

a clock frequency control means for producing frequency-controlled clock signals each in accordance with respective one of horizontal display area size ratios Z/Y and (Y−Z)/Y and with the predetermined compression ratio, when to divide said display screen into a first area having an aspect ratio of X:Z (Z<Y) and a second screen area having an aspect ratio of X:(Y−Z); and a display control means for sampling each image signal in the synthesized image signal by a respective one of said frequency-control clock signals and thereby displaying images on said first and second areas.

2. The image display device of claim 1, wherein said signal compression means comprises a storage means for storing said image signal, a writing control means for writing image signal into said storage means at a writing speed, and a reading control means for reading the image signal at a speed higher than said writing speed.

3. The image display device of claim 1, wherein said first area has an aspect ratio of 9:8 while said display screen has an aspect ratio of 16:9.

4. The image display device of claim 1, wherein said first area has an aspect ratio of 12:9 while said display screen has an aspect ratio of 16:9.

5. A method for displaying at least one image on a display screen having an aspect ratio of X:Y by sequentially sampling inputted image signals, said method comprising the steps of:

compressing the inputted image signals along a time axis at a predetermined compression ratio;

producing a synthesized image signal from at least one of compressed image signals during each horizontal scanning period;

controlling frequencies of clock signals to produce frequency-controlled clock signals each in accordance with respective one of horizontal display area size ratios Z/Y and (Y−Z)/Y and with the predetermined compression ratio, when to divide said display screen into a first area having an aspect ratio of X:Z (Z<Y) and a second screen area having an aspect ratio of X:(Y−Z); and sampling each image signal in said synthesized image signal by a respective one of said frequency-controlled clock signals and thereby displaying images on said first and second areas.

6. The method as set forth in claim 5, wherein said step of compressing the inputted image signals comprises steps of storing said image signal, writing the image signal into memory at a writing speed, and reading the image from the memory at a reading speed higher than the writing speed.

7. The method as set forth in claim 5, wherein said first area has an aspect ratio of 9:8 while said display screen has an aspect ratio of 16:9.

8. The method as set forth in claim 5, wherein said first area has an aspect ratio of 12:9 while said display screen has an aspect ratio of 16:9.

* * * * *